US008405581B2

(12) United States Patent
Smith et al.

(10) Patent No.: US 8,405,581 B2
(45) Date of Patent: Mar. 26, 2013

(54) IMAGE PROCESSING SYSTEMS

(75) Inventors: Euan Christopher Smith, Cambridgeshire (GB); Peter Mash, Colorado Springs, CO (US); Adrian Cable, Cambridgeshire (GB)

(73) Assignee: Cambridge Display Technology Limited (GB)

( * ) Notice: Subject to any disclaimer, the term of this patent is extended or adjusted under 35 U.S.C. 154(b) by 748 days.

(21) Appl. No.: 12/225,439

(22) PCT Filed: Mar. 21, 2007

(86) PCT No.: PCT/GB2007/050140

§ 371 (c)(1), (2), (4) Date: Jan. 23, 2009

(87) PCT Pub. No.: WO2007/107794

PCT Pub. Date: Sep. 27, 2007

(65) Prior Publication Data

US 2009/0128459 A1 May 21, 2009

(30) Foreign Application Priority Data

Mar. 23, 2006 (GB) ..... 0605756.6

(51) Int. Cl.
*G09G 3/30* (2006.01)

(52) U.S. Cl. ..... 345/76; 345/80

(58) Field of Classification Search ..... 345/12–80, 345/204, 530, 643, 644
See application file for complete search history.

(56) References Cited

U.S. PATENT DOCUMENTS

| | | | | |
|---|---|---|---|---|
| 4,539,507 | A | 9/1985 | VanSlyke et al. | |
| 6,243,072 | B1 * | 6/2001 | McKnight | 345/690 |
| 6,812,936 | B2 * | 11/2004 | Hoppenbrouwers | 345/691 |
| 7,660,485 | B2 * | 2/2010 | Collins | 382/276 |
| 7,668,398 | B2 * | 2/2010 | Collins et al. | 382/276 |
| 2003/0076048 | A1 * | 4/2003 | Rutherford | 315/169.3 |
| 2003/0214493 | A1 | 11/2003 | Akimoto et al. | |
| 2004/0066363 | A1 * | 4/2004 | Yamano et al. | 345/98 |
| 2004/0155894 | A1 * | 8/2004 | Van Dijk | 345/692 |
| 2004/0257359 | A1 | 12/2004 | Muroi et al. | |
| 2005/0021333 | A1 * | 1/2005 | Smaragdis | 704/236 |
| 2005/0024391 | A1 * | 2/2005 | Damera-Venkata et al. | 345/698 |
| 2006/0044294 | A1 * | 3/2006 | Damera-Venkata | 345/204 |

FOREIGN PATENT DOCUMENTS

| | | | |
|---|---|---|---|
| EP | 0953956 | A1 | 11/1999 |
| GB | 2327798 | | 2/1999 |
| GB | 2421604 | | 6/2006 |
| WO | WO-2004/001707 | A2 | 12/2003 |
| WO | WO-2004/088568 | A2 | 10/2004 |
| WO | WO-2006/035246 | A1 | 4/2006 |
| WO | WO-2006/035248 | A1 | 4/2006 |
| WO | WO-2006/067520 | A2 | 6/2006 |

OTHER PUBLICATIONS

"International Patent Application U.S. Appl. No. PCT/GB2007/050140, International Search Report mailed Jul. 5, 2007", 3 pgs.

* cited by examiner

*Primary Examiner* — Amare Mengistu
*Assistant Examiner* — Stacy Khoo
(74) *Attorney, Agent, or Firm* — Schwegman Lundberg & Woessner, P.A.

(57) ABSTRACT

Embodiments relate to systems and methods for displaying images using multi-line addressing (MLA) or total matrix addressing (TMA) techniques, with reduced noise. Embodiments of the invention are particularly useful for driving OLED (organic light emitting diode) displays.

8 Claims, 5 Drawing Sheets

IMAGE PROCESSING SYSTEMS

RELATED APPLICATIONS

This application is a nationalization under 35 U.S.C. 371 of PCT/GB2007/050140, filed Mar. 21, 2007 and published as WO 2007/107794 A1, on Sep. 27, 2007, which claimed priority under 35 U.S.C. 119 to United Kingdom Patent Application Serial No. 0605756.6, filed Mar. 23, 2006; which applications and publication are incorporated herein by reference and made a part.

This invention generally relates to image processing systems. More particularly it relates to systems and methods for displaying images using multi-line addressing (MLA) or total matrix addressing (TMA) techniques with reduced noise. Embodiments of the invention are particularly useful for driving OLED (organic light emitting diode) displays.

BACKGROUND OF THE INVENTION

We have previously described how techniques for multi-line addressing (MLA) and total matrix addressing (TMA) in particular using non-negative matrix factorisation (NMF) may be advantageously employed in OLED display driving (see in particular our International application PCT/GB2005/050219, hereby incorporated by reference in its entirety). We now describe further improvements to these techniques in which, broadly speaking, multiple frame sets are employed for noise reduction and improved image quality. Background prior art can be found in US2003/0214493; US2004/0257359; EP 0953956A; and GB 2327798A.

DETAILED DESCRIPTION OF THE INVENTION

Multi Line Addressing and Total Matrix Addressing

To aid in understanding embodiments of the invention we first review multi-line addressing (MLA) techniques, a preferred special case of which comprises total matrix addressing (TMA) techniques. These are preferably employed with passive matrix OLED displays, that is displays which do not include a memory element for each pixel (or colour sub-pixel) and must therefore be continually refreshed. In this specification OLED displays include displays fabricated using polymers, so-called small molecules (for example U.S. Pat. No. 4,539,507), dendrimers, and organometallic materials; the displays may be either monochrome or colour.

In a conventional passive matrix display the display is driven line-by-line and hence a high drive is required for each line because it is only illuminated for a fraction of the frame period. MLA techniques drive more than one line at once and in TMA techniques all the lines are driven simultaneously and an image is built up from a plurality of successively displayed subframes which, when integrated in the observer's eye, give the impression of the desired image. The required luminescence profile of each row (line) is built up over a plurality of line scan periods rather than as an impulse in a single line scan period. Thus the pixel drive during each line scan period can be reduced, hence extending the lifetime of the display and/or reducing the power consumption due to a reduction of drive voltage and reduced capacitive losses. This is because OLED lifetime reduces with the pixel drive (luminance) to a power typically between 1 and 2 but the length of time for which a pixel must be driven to provide the same apparent brightness to an observer increases only substantially linearly with decreasing pixel drive. The degree of benefit depends in part upon the correlation between the groups of lines driven together.

Figure 1A:
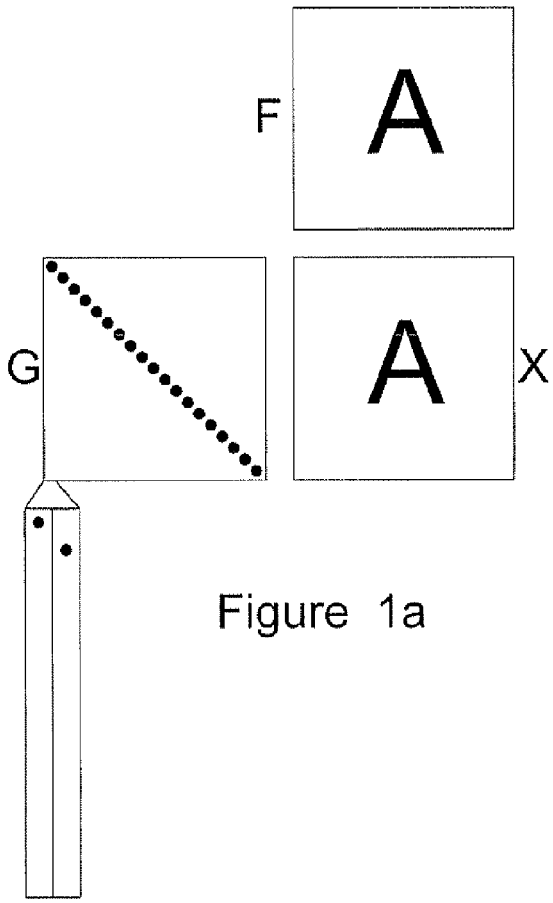
FIG. 1*a* shows row G, column F and image X matrices for a convention drive scheme in which one row is driven at a time.
Figure 1B:
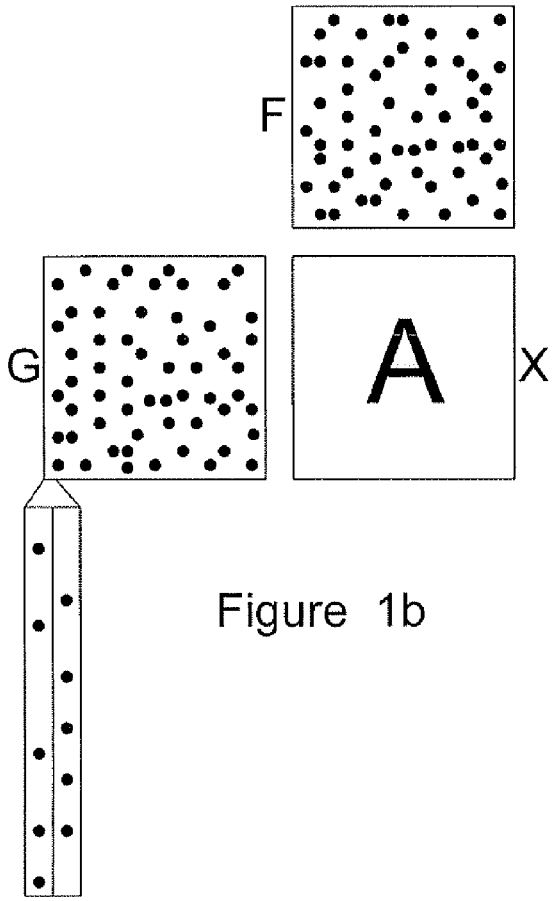
FIG. 1*b* shows row, column, and image matrices for a multiline addressing scheme.
Figure 1C:
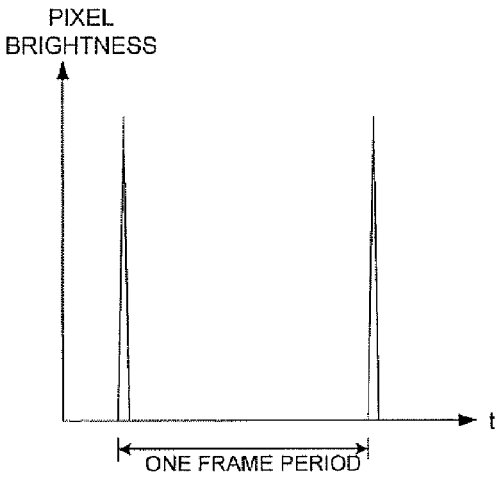
FIGS. 1*c* and 1*d* illustrate, for a typical pixel of the displayed image, the brightness of the pixel, or equivalently the drive to the pixel, over a frame period.
Figure 1D:
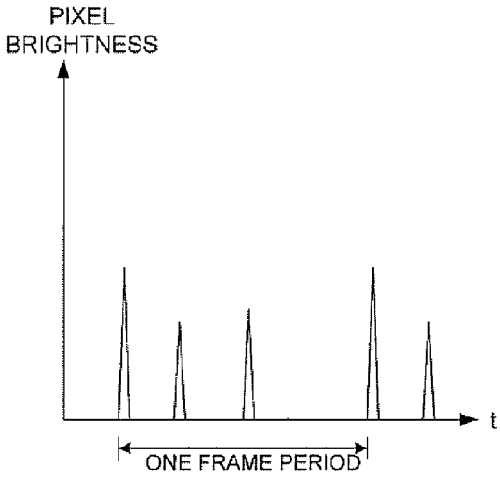

FIG. 1*a* shows row G, column F and image X matrices for a conventional drive scheme in which one row is driven at a time. FIG. 1*b* shows row, column and image matrices for a multiline addressing scheme. FIGS. 1*c* and 1*d* illustrate, for a typical pixel of the displayed image, the brightness of the pixel, or equivalently the drive to the pixel, over a frame period, showing the reduction in peak pixel drive which is achieved through multiline addressing.

The problem is to determine sets of row and column drive signals for the subframes so that a set of subframes approximates the desired image. We have previously described solutions to this problem in International Patent Applications Nos. GB2005/050167-9 (all three of which applications are hereby incorporated by reference in their entirety). A preferred technique employs non-negative matrix factorisation of a matrix describing the desired image. The factor matrices, the elements of which are positive since the OLED display elements provide a positive (or zero) light emission, essentially define the row and column drive signals for the subframes. We describe later one preferred NMF technique in the context of which embodiments of the invention may operate, although techniques may also be employed.

Referring to FIG. 1*a* we first describe an overall OLED display system 100 which incorporates a display drive data processor 150 which may implement embodiments of the invention in either hardware (preferred), software, or a combination of the two.

Figure 2A:
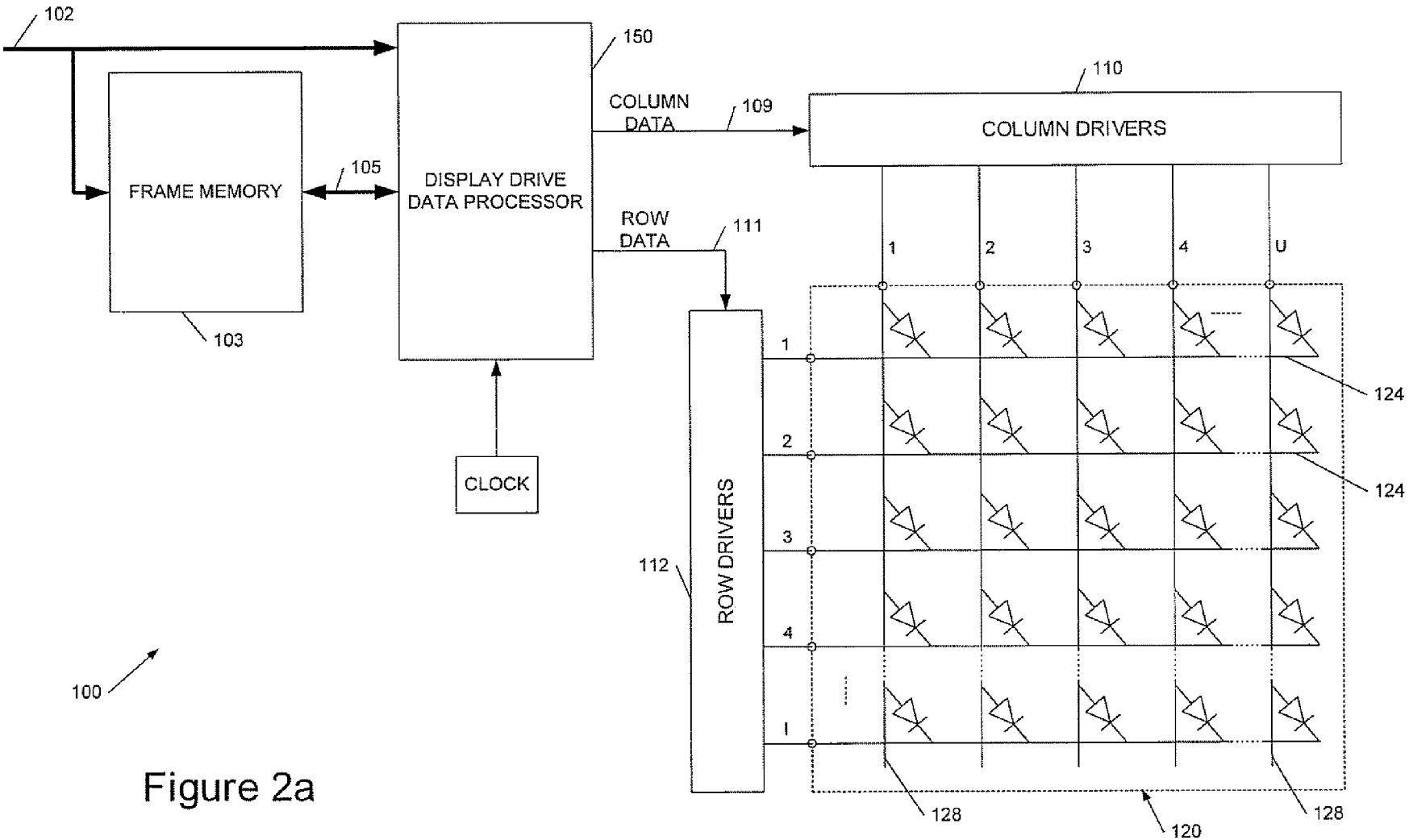
FIG. 2*a* show a passive matrix OLED display having row electrodes driven by row driver circuits and column electrodes driven by column drives.

In FIG. 2*a* a passive matrix OLED display 120 has row electrodes 124 driven by row driver circuits 112 and column electrodes 128 driven by column drives 110. Details of these row and column drivers are shown in FIG. 1*b*. Column drivers 110 have a column data input 109 for setting the current drive to one or more of the column electrodes; similarly row drivers 112 have a row data input 111 for setting the current drive ratio to two or more of the rows. Preferably inputs 109 and 111 are digital inputs for ease of interfacing; preferably column data input 109 sets the current drives for all the U columns of display 120.

Data for display is provided on a data and control bus 102, which may be either serial or parallel. Bus 102 provides an input to a frame store memory 103 which stores luminance data for each pixel of the display or, in a colour display, luminance information for each sub-pixel (which may be encoded as separate RGB colour signals or as luminance and chrominance signals or in some other way). The data stored in frame memory 103 determines a desired apparent brightness for each pixel (or sub-pixel) for the display, and this information may be read out by means of a second, read bus 105 by display drive data processor 150. Display drive data processor 150 preferably performs input data pre-processing, NMF, and post-processing.

Figure 2B:
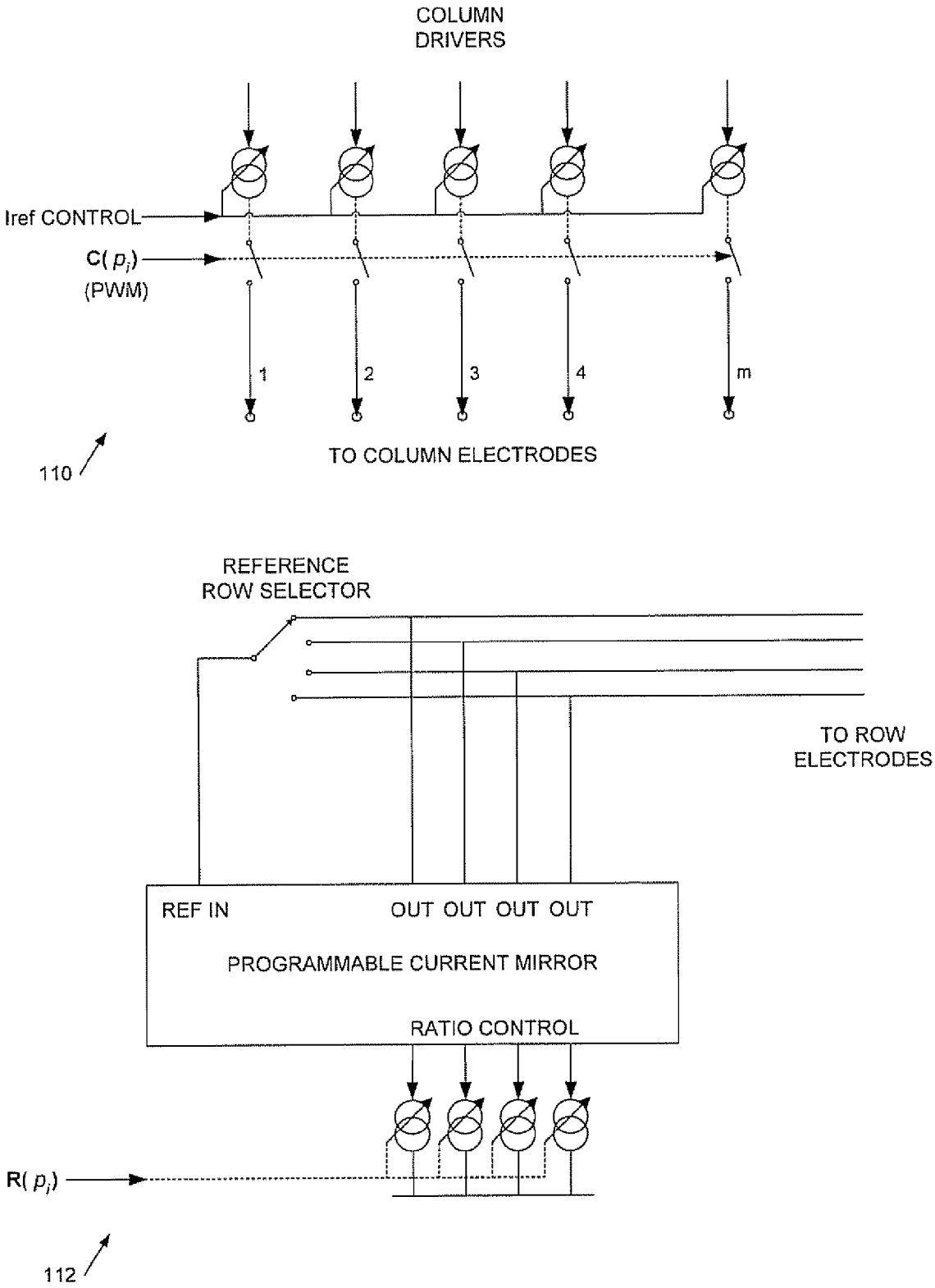
FIG. 2*b* illustrates row and column drivers suitable for driving a display with a factorized image matrix.

FIG. 2*b* illustrates row and column drivers suitable for driving a display with a factorised image matrix. The column drivers 110 comprise a set of adjustable substantially constant current sources which are ganged together and provided with a variable reference current $I_{ref}$ for setting the current into each of the column electrodes. This reference current is pulse width modulated (PWM) by a different value for each column derived from a row of an NMF factor matrix. OLEDs have a quadratic current-voltage dependence, which constrains independent control of the row and column drive variables. PWM is useful as it allows the column and row drive variables to be decoupled from one another.

With PWM drive, rather than always have the start of the PWM cycle an "on" portion of the cycle, the peak current can be reduced by randomly dithering the start of the PWM cycle. A similar benefit can be achieved with less complexity by starting the "on" portion timing for half the PWM cycles at the end of the available period in cases where the off-time is greater than 50%. This is potentially able to reduce the peak row drive current by 50%.

The row driver 112 comprises a programmable current mirror, preferably with one output for each row of the display (or for each row of a block of simultaneously driven rows). The row drive signals are derived from a column of an NMF factor matrix and row driver 112 distributes the total column current for each row so that the currents for the rows are in a ratio set by the ratio control input (R). Further details of suitable drivers can be found in the Applicant's PCT application GB2005/010168 (hereby incorporated by reference).

Since (in this arrangement) the row signals are effectively normalised by the row driver, in post-processing the column drive reference current and/or the sub-frame time are adjusted to compensate. Optionally but preferably the post-processing also adjusts duration of each sub-frame, for example proportional to the brightness of brightest pixel in a sub-frame, so that high luminance is achieved by increased duration as well as increased drive (thus extending pixel lifetime). More details of this technique can be found in our UK patent application number 0605755.8 filed on 23 Mar. 2006, hereby incorporated by reference.

We now describe one preferred NMF calculation:

An input image is given by matrix V with elements $V_{xy}$, R denotes a current row matrix, C a current column matrix, Q a remaining error between V and R.C, p the number of sub-frames, average an average value, and gamma an optional gamma correction function.

The variables are initialised as follows:

$$\alpha v = \text{average}(\text{gamma}(V_x))$$

$$\text{initial}RC = \sqrt{(\alpha v/p)}$$

$$Q_{xy} = \text{gamma}(V_{xy}) - \alpha v$$

An embodiment of the NMF system then performs the following calculation for p=1 to the total number of sub-frames:

start $$Q_{xy} = Q_{xy} + R_{py}C_{xp} \text{ for each } x \text{ and } y$$

$$R_{py} = \frac{\text{bias} + \sum_x Q_{xy}C_{xp}}{\text{bias} + \sum_x C_{xp}C_{xp}} \text{ for each } y$$

$$C_{xp} = \frac{\text{bias} + \sum_y Q_{xy}R_{py}}{\text{bias} + \sum_y R_{py}R_{py}} \text{ for each } x$$

$$Q_{xy} = Q_{xy} - R_{py}C_{xp} \text{ for each } x \text{ and } y$$

loop to start ($p \leftarrow p + 1$)

The variable bias prevents division by zero, and the values of R and C pull towards this value. A value for bias may be determined by initialRC×weight×no.of.columns where the number of columns is x and the weight is, for example, between 64 and 128.

Broadly speaking the above calculation can be characterised as a least squares fit. The matrix Q initially begins as a form of target matrix since the row R and column C matrices are generally initialised so that all their elements are the same and equal to the average value initialRC. However from then on matrix Q represents a residual difference between the image and the result of combining the subframes—so ideally Q=0. Thus, broadly speaking, the procedure begins by adding the contribution for subframe p and then for each row finds the best column values, and afterwards for each column finds the best row values. The updated row and column values are then subtracted back from Q and the procedure continues with the next subframe. Typically a number of iterations, for example between 1 and 100, is performed so that the R and C for a set of subframes converge towards a best fit. The number of subframes p employed is an empirical choice but may, for example, be between 1 and 1000.

Figure 1E:
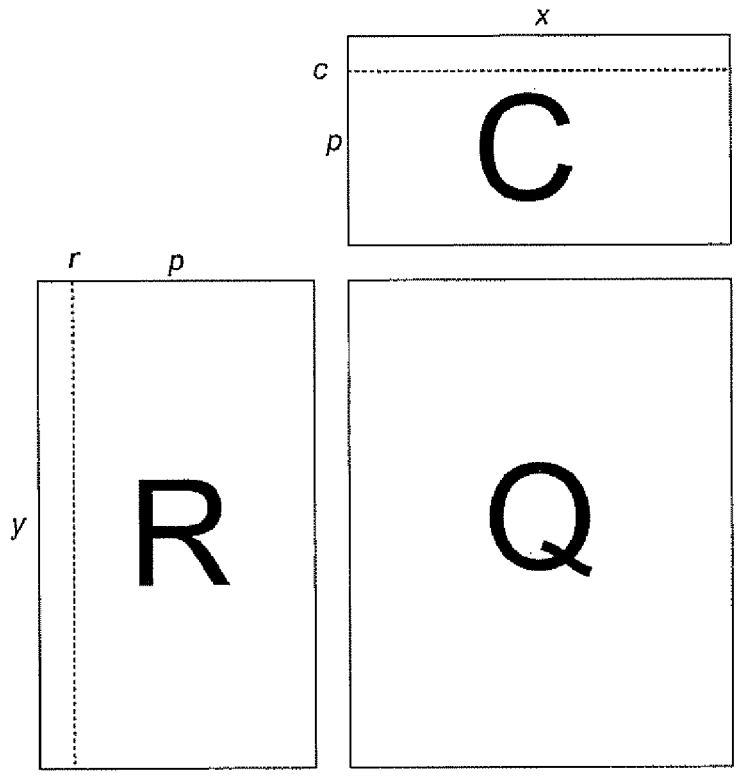
FIG. 1*e* illustrates schematically the factorization of Q into row and column factor matrices R and C.
Figure 1F:
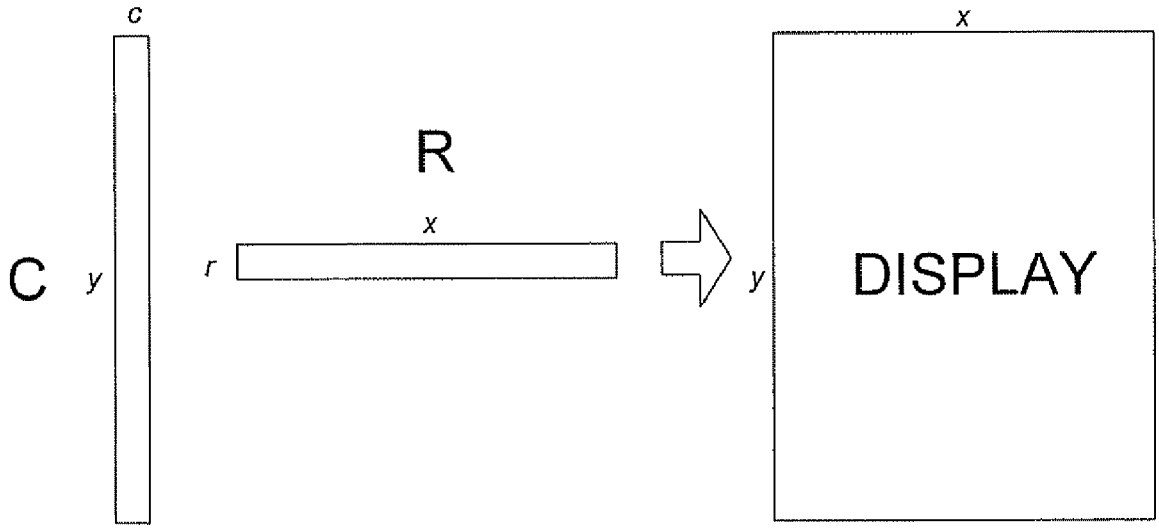
FIG. 1*f* illustrates schematically driving a display with one temporal sub-frame using subframe data from the row and column factor matrices R and C.

The factorisation of Q into row and column factor matrices R and C is schematically illustrated in FIG. 1*e*. FIG. 1*f* is schematically illustrates driving a display with one temporal sub-frame using sub-frame data from the row and column factor matrices R and C.

In this description the skilled person will understand that references to rows and columns are interchangeable and that, for example, in the above equation system the order of processing to determine updated $R_{py}$ and $C_{xp}$ values may be exchanged.

In the above set of equations preferably all integer arithmetic is employed, and preferably R and C values comprise 8 bit values and Q comprises signed 16 bit values. Then, although the determination of R and C values may involve rounding off there is no round-off error in Q since Q is updated with the rounded off values (and the product of R and C values cannot be greater than maximum value which can be accommodated within Q). The above procedure may straightforwardly be applied to pixels of a colour display (details later). Optionally a weight W matrix may be employed to weight errors in low luminance values higher, because the eye is disproportionately sensitive to imperfect blacks. A similar weighting may be applied to increase the weight of errors in a green colour channel, because the eye is disproportionately sensitive to green errors.

A typical set of parameters for a practical implementation of a display driver system based upon the above NMF procedure might have a desired frame rate of 25 frames per second, each frame comprising 20 iterations of the procedure, with, for example, 160 subframes. The NMF procedure may be implemented in software, for example on a DSP (digital signal processor) but we have also described (UK patent application no. 0605748.3 filed on 23 Mar. 2006, hereby incorporated by reference) a hardware architecture that enables a cheaper, lower-power implementation of the procedure.

Broadly speaking we will describe systems and methods for displaying an image on a TMA driven display in which image error is reduced by calculating two or more image frames, generally from different starting points, optionally with accumulated error in the second (and optionally later) frames, and displaying these rapidly in sequence.

According to the present invention there is therefore provided a method of driving an electroluminescent display to display an image, the method comprising: inputting image data for said image; determining, using said image data, a first set of image subframe data for a first plurality of image subframes each representing a common spatial portion of said image, wherein said first plurality of image subframes combine to approximate said common spatial portion of said image; driving said display using said first set of image subframe data; determining, using said image data, a second set of image subframe data for a second plurality of image subframes each representing said common spatial portion of said image, wherein said second plurality of image subframes combine to approximate said common spatial portion of said image; and driving said display using said second set of image subframe data.

In embodiments of the method, calculating two sets of subframes for a single image enables an overall reduction in noise. The data for the two sets of subframes may be displayed in a variety of different orders, for example the first set of subframes followed by the second set of subframes, or interleaved subframes from the first and second sets, or in some other order. In a TMA embodiment a subframe may represent the complete image or at least a complete colour plane of the image.

In preferred embodiments of the method the image data defines a target image matrix which is factorised, preferably using NMF, into first and second factor matrices. This procedure is performed twice so that two pairs of factor matrices are determined for a single image, more precisely for a single processed spatial region of the image. In the preferred embodiment of the NMF procedure described above the first and second (row and column) factor matrices are initialised to an average pixel luminance value (here luminance may mean, in the context of a colour display, the luminance of a pixel of a particular colour). In such embodiments to generate two different sets of subframes the factor matrices are preferably initialised to different values prior to the factorisation. In some particularly preferred embodiments following one factorisation a residual error may be employed (added to the target image) when determining the second set of subframes. In this way the image generated by the second set of subframes at least partially compensates for the representation of the image by the approximation comprising the first set of subframes. Thus the number of subframes in each set may be less than that needed for a target signal-to-noise (SNR) ratio provided that, taken together, the two images defined by the first and second sets of subframes combine (in the observer's eye) to generate a displayed image with at least the target SNR. In various embodiments, said displayed image has a target signal-to-noise ratio (SNR), and wherein the number of said first and second subframes is chosen such that each set of subframes, individually, fails to meet said target SNR.

The method may be extended to calculate and display a third set of image subframes, and so forth.

In another aspect the invention further provides a driver for driving an electroluminescent display to display an image, the driver comprising: an input to receive input data for said image; means for determining, using said image data, a first set of image subframe data for a first plurality of image subframes each representing a common spatial portion of said image, wherein said first plurality of image subframes combine to approximate said common spatial portion of said image; means for determining, using said image data, a second set of image subframe data for a second plurality of image subframes each representing said common spatial portion of said image wherein said second plurality of image subframes combine to approximate said common spatial portion of said image; and an output for driving said display using said first and second sets of image subframe data.

The method may be employed with video data, either separately to each frame of the video (or interlaced field), or to a sequence of video frames each successive frame compensating the noise in the previous frame. This may be useful where the image does not change substantially from frame to frame, or where the image changes in a known way, for example by the addition of an object or a general darkening. In embodiments the factorisation may be "reset" at intervals, for example by calculating a factorisation which does not depend on a previously factorised frame of the video.

Optionally the factorisation may also be "reset" in response to changes in the video, for example from a real time moving image to text. In embodiments the video frame rate may also be adjusted, for example to use a half frame rate instead of two sets of subframes per image frame (or more generally to reduce the frame rate proportionate to the number of sets of sub-frames employed). This may be responsive to the displayed data, for example, to reduce the frame rate when text is displayed.

Thus the invention further provides a method of driving an electroluminescent display to display successive image frames of video data, the method comprising: inputting image data for a first said frame; determining, using said image data, a first set of image subframe data for a first plurality of image subframes each representing a common spatial portion of said first image frame, wherein said first plurality of image subframe combine to approximate said common spatial portion of said first image frame; driving said display using said first set of image subframe data; inputting image data for a next said frame; determining, using said image data, a second set of image subframe data for a second plurality of image subframes each representing said common spatial portion of said next image frame, wherein said second plurality of image subframes combine to approximate said common spatial portion of said next image frame, and wherein said determining takes into account an error in said approximating of said first image frame.

The invention further provides a driver for driving an electroluminescent display to display successive image frames of video data, the driver comprising: an input to receive said video data; means for determining, using said image data, a first set of image subframe data for a first plurality of image subframes each representing a common spatial portion of said first image frame, wherein said first plurality of image subframes combine to approximate said common spatial portion of said first image frame; means for determining, using said image data, a second set of image subframe data for a second plurality of image subframes each representing said common spatial portion of said next image frame, wherein said second plurality of image subframes combine to approximate said common spatial portion of said next image frame, and wherein said determining takes into account an error in said approximating of said first image frame; and an output for driving said display using said first and second sets of image subframe data.

In a still further aspect the invention provides a method of improving a displayed image quality in an electroluminescent display in which an image is produced by generating a set of subframes comprising a plurality of temporal subframes displayed in rapid succession so that they integrate in an observer's eye to create the image, the method comprising: generating a plurality of different said sets of temporal subframes each set configured to, in combination, approximate said image; and displaying said plurality of sets of subframes so that they integrate in said observer's eye to create an improved approximation of said image.

The invention still further provides a driver for an electro-optic display, the display having a plurality of pixels each addressable by a row electrode and a column electrode, the driver comprising: an input for receiving image data for display, said image data defining an image matrix; a system to factorise said image matrix into a product of at least first and second factor matrices, said first factor matrix defining row drive signals for said display, said second factor matrix defining column drive signals for said display; an output to output said row and column drive signals defined by said first and second factor matrices; and a controller to control said factorising system to factorise a said image matrix at least twice for a single image for display to generate two sets of said row and column drive signals for output.

The invention still further provides a driver for an electro-optic display, more particularly an emissive display such as an OLED display, incorporating means for implementing a method as described above. Examples of electroluminescent displays which may be employed with such a driver and with the above described methods include a passive matrix OLED display, an inorganic LED display, a plasma display, a vacuum fluorescent display, and thick and thin film electroluminescent displays as iFire® displays. The electro-optic display may be either colour or monochrome.

The invention further provides processor control code to implement the above-described methods, for example on a general purpose computer system or on a digital signal processor (DSP). The code may be provided on a carrier such as a disk, CD- or DVD-ROM, programmed memory such as read-only memory (Firmware), or on a data carrier such as an optical or electrical signal carrier. Code (and/or data) to implement embodiments of the invention may comprise source, object or executable code in a conventional programming language (interpreted or compiled) such as C, or assembly code. The above described methods may also be implemented, for example, on an FPGA (field programmable gate array) or in an ASIC (application specific integrated circuit). Thus the code may also comprise code for setting up or controlling an ASIC or FPGA, or code for a hardware description language such as Verilog (Trade Mark), VHDL (Very high speed integrated circuit Hardware Description Language), or RTL code or SystemC. Typically dedicated hardware is described using code such as RTL (register transfer level code) or, at a higher level, using a language such as C. As the skilled person will appreciate such code and/or data may be distributed between a plurality of coupled components in communication with one another.

Figure 3:
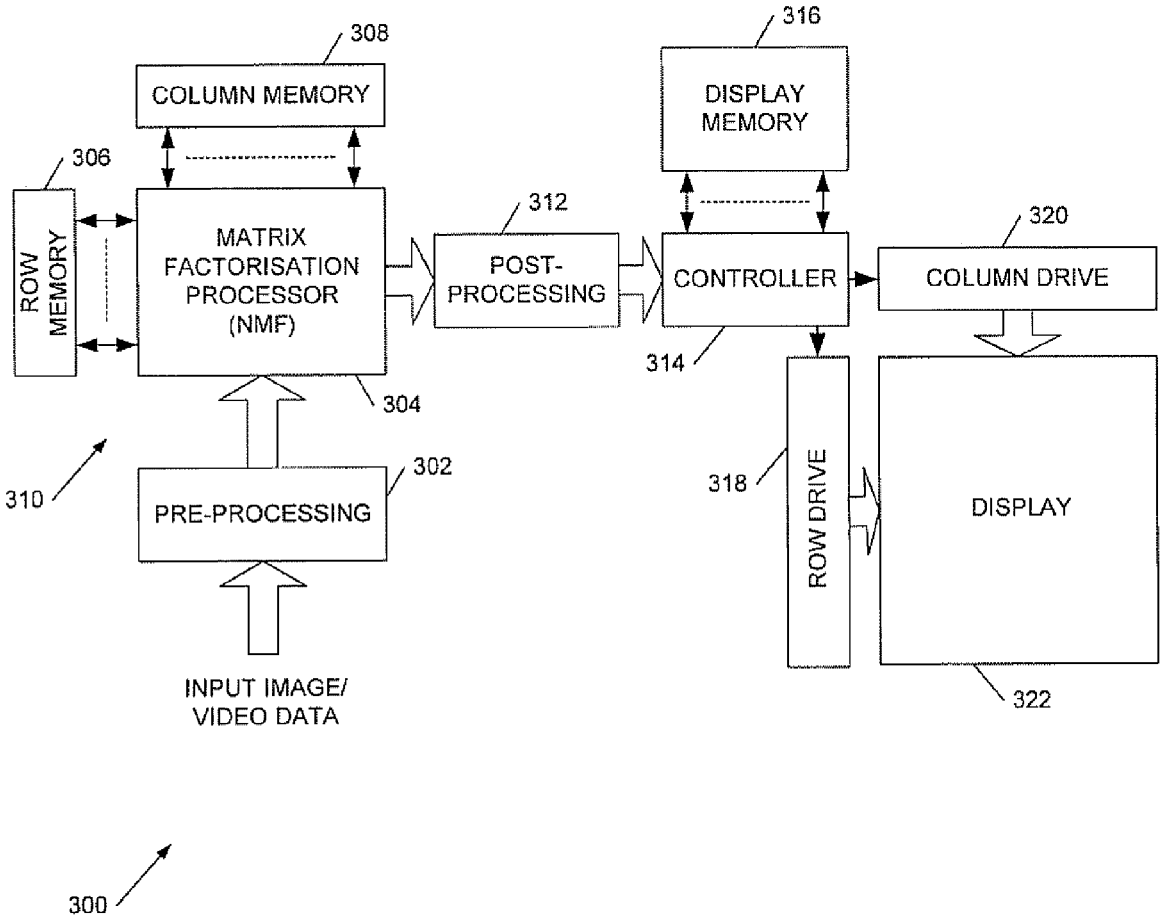
FIG. 3 shows a further example of an OLED display and driver system for implementing an embodiment of the invention.

These and other aspects of the invention will now be further described, by way of example only, with reference to the accompanying figures in which:

FIGS. 1*a* to 1*f* show row, column and image matrices for a conventional drive scheme and for a multi-line addressing drive scheme respectively, and corresponding brightness curves for a typical pixel over a frame period, factorisation of a target matrix into row and column factor matrices, and driving a display with one temporal sub-frame using subframe data from the row and column factor matrices;

FIGS. 2*a* and 2*b* show, respectively, an OLED display and driver including an NMF hardware accelerator according to an embodiment of the invention, and details of example row and column drivers for the display; and FIG. 3 shows a further example of an OLED display and driver system for implementing an embodiment of the invention.

Referring back to the above described NMF method, in one embodiment the TMA frame averaging procedure performs an NMF calculation as previously described on the same image twice, starting from different, for example random, starting points. As previously mentioned generally the image is initially represented by the target matrix Q, which at the end of the procedure represents the difference between the target and the image generated by the calculated set of subframes. The starting point of the procedure is defined by the initial contents of the row and column matrices R and C. Once the TMA calculation has been performed twice both subframe sets are displayed in sequence at a sufficiently high refresh rate that, to a user (observer) the two images average together giving the impression of the single, target image. Where the noise in the image arising from the NMF calculation is substantially random, this noise is reduced.

In a variant of this procedure a first TMA (NMF) calculation is performed, and then a second calculation is performed adding the error in the first image reproduction to the target image for the second calculation. This may be done in a number of mathematically equivalent ways. One method, for example, is to add the residual Q matrix from the previous calculation to the new (target) Q matrix for the second TMA (NMF) calculation. The resultant sets of subframes are then displayed as before.

Where a sequence of frames is factorised, for example for video, the residual Q matrix from the previous calculation may be multiplied by a decay factor of less than unity, for example 0.7, so that the effect of previous frames gradually diminishes.

The skilled person will understand that the above described methods may be extended to use more than two frames. Further, because two or more frames are displayed for each image each frame may have a reduced number of subframes and yet still achieve a desired target signal-to-noise ratio. For example the method may be applied to a full frame rate calculation as described above typically between 25 fps and 100 fps, in the method half the usual number of subframes being employed with the residual error being passed to the second frame for correction in the second set of subframes. This uses substantially the same number of calculations as displaying a single set of subframes for each image but has the potential to provide improved image quality.

FIG. 3 shows a block diagram of a further example of a system 300 configured to implement an embodiment of the invention. The system of FIG. 3 includes a non-negative matrix factorisation system 310 to perform NMF as described above, either for example, on a digital signal processor (DSP) or, in some preferred embodiments, in hardware (as described for example in the Applicant's co-pending UK patent application no. 0605748.3 filed on the same day as this application). The NMF system comprises an NMF processor 304 which is loaded with the target image data and which is coupled to row 306 and column 308 memory blocks for storing factor matrices R and C.

The system 300 receives input image data, which may be monochrome or colour video data, and performs optional pre-processing 302 for example for gamma correction. The NMF output from system 310 is provided to an optional but preferable post-processor 312 for modifying the display periods of individual sub-frames in order to optimise the benefits of TMA driving (preferably as described in the Applicant's co-pending UK patent application no. 0605755.8 filed on the same day as this application). The data is then passed to a controller 314 coupled to display memory 316 and to row 318 and column 320 drivers for driving OLED display 322. For example, for, say a colour QVGA display the display memory may have 320×240×3 memory locations.

The skilled person will understand that since in embodiments of the invention two (or more) sets of subframes are employed, each set derived from a factorisation of the image matrix, for a given total number of subframes the memory requirements of the NMF system are divided by two (or more).

Embodiments of the above described techniques provide image data processing which facilitates improved quality passive matrix TV-sized screens (say 8" and above) with only slightly higher power consumption, and vastly lower cost, than active matrix equivalents.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of driving an electroluminescent display to display an image, the method comprising:

inputting image data for said image;

determining, using said image data, a first set of image subframe data for a first plurality of image subframes each representing a common spatial portion of said image, wherein said first plurality of image subframes are determined to, when successively displayed, combine to approximate said common spatial portion of said image;

driving said display using said first set of image subframe data;

determining, using said image data, a second set of image subframe data for a second plurality of image subframes each representing said common spatial portion of said image, wherein said second plurality of image subframes are determined to, when successively displayed, combine to approximate said common spatial portion of said image; and driving said display using said second set of image subframe data;

wherein said image data defines a target image matrix, and wherein each of said determining of said first set of image subframe data and said determining of said second set of image subframe data comprises factorising said target matrix into first and second factor matrices defining data for respective first and second axes of said display, each of the first set of image subframe data and said second set of image subframe data defining data for a plurality of said subframes, said target matrix substantially a product of at least said first and second factor matrices, wherein, for each of said determining of said first set of image subframe data and said determining of said second set of image subframe data, the determining the set of image subframe data comprises iteratively determining the first and second factor matrices of the image subframe data on the basis of initial value data of said first and second factor matrices, said iterative determining such that an error between the target matrix and a result of combining of the subframes defined by the determined first and second factor matrices of the iterations converges towards zero as successive said iterations are performed; and wherein said initial value data is different for said determining of said first and second sets of subframe data.

2. A method as claimed in claim 1 wherein said determining of said first set of image subframe data includes determining residuals data representing said error in said approximating said common spatial portion of said image; and wherein said determining of said second set of image subframe data comprises determining a set of image subframes to approximate a combination of said common spatial portion of said image and said residuals data.

3. A method as claimed in claim 2 wherein said displayed image has a target signal-to-noise ratio (SNR), and wherein the number of said first and second subframes is chosen such that each set of subframes, individually, fails to meet said target SNR.

4. A method as claimed in claim 1 further comprising determining, using said image data, a third set of image subframe data for a third plurality of image subframes each representing said common spatial portion of said image, wherein said third plurality of image subframes, when successively displayed, combine to approximate said common spatial portion of said image; and driving said display using said third set of image subframe data.

5. A method of driving an electroluminescent display with video data using the method of claim 1 for each displayed video frame wherein an error in displaying one frame is taken into account when determining subframe data for displaying the next video frame.

6. A method as claimed in claim 1 wherein said electroluminescent display comprises an OLED display.

7. A non-transitory carrier carrying processor control code operable to, when running, cause a processor to execute a method of driving an electroluminescent display to display an image, the method comprising:

receiving an input of image data for said image;

determining, using said image data, a first set of image subframe data for a first plurality of image subframes each representing a common spatial portion of said image, wherein said first plurality of image subframes are determined to, when successively displayed, combine to approximate said common spatial portion of said image;

outputing said first set of image subframe data;

determining, using said image data, a second set of image subframe data for a second plurality of image subframes each representing said common spatial portion of said image, wherein said second plurality of image subframes are determined to, when successively displayed, combine to approximate said common spatial portion of said image; and outputing said second set of image subframe data wherein said image data defines a target image matrix, and wherein each of said determining of said first set of image subframe data and said determining of said second set of image subframe data comprises factorising said target matrix into first and second factor matrices defining data for respective first and second axes of said display, each of said first set of image subframe data and said second set of image subframe data defining data for a plurality of said subframes, said target matrix substantially a product of at least said first and second factor matrices, wherein, for each of said determining of said first set of image subframe data and said determining of said second set of image subframe data, the determining the set of image subframe data comprises iteratively determining the first and second factor matrices of the image subframe data on the basis of initial value data of said first and second factor matrices, said iterative determining such that an error between the target matrix and a result of combining of the subframes defined by the determined first and second factor matrices of the iterations converges towards zero as successive said iterations are performed; and wherein said initial value data is different for said determining of said first and second sets of subframe data.

8. A driver for driving an electroluminescent display to display an image, the driver comprising:

an input to receive input data for said image;

means for determining, using said image data, a first set of image subframe data for a first plurality of image subframes each representing a common spatial portion of said image, wherein said first plurality of image subframes are determined to, when successively displayed, combine to approximate said common spatial portion of said image;

means for determining, using said image data, a second set of image subframe data for a second plurality of image subframes each representing said common spatial portion of said image, wherein said second plurality of image subframes are determined to, when successively displayed, combine to approximate said common spatial portion of said image; and an output for driving said display using said first and second sets of image subframe data;

wherein said image data defines a target image matrix, and wherein each of said determining of said first set of image subframe data and said determining of said second set of imaged subframe data comprises factorising said target matrix into first and second factor matrices defining data for respective first and second axes of said display, each of said first set of image subframe data and said second set of image subframe data defining data for a plurality of said subframes, said target matrix substantially a product of at least said first and second factor matrices, wherein, for each of said determining of said first set of image subframe data and said determining of said second set of image subframe data, the determining the set of image subframe data comprises iteratively determining the first and second factor matrices of the image subframe data on the basis of initial value data of said first and second factor matrices, said iterative determining such that an error between the target matrix and a result of combining of the subframes defined by the determined first and second factor matrices of the iterations converges towards zero as successive said iterations determining are performed; and wherein said initial value data is different for said determining of said first and second sets of subframe data.

* * * * *

UNITED STATES PATENT AND TRADEMARK OFFICE

CERTIFICATE OF CORRECTION

PATENT NO. : 8,405,581 B2
APPLICATION NO. : 12/225439
DATED : March 26, 2013
INVENTOR(S) : Smith et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 990 days.

Signed and Sealed this
First Day of September, 2015

Michelle K. Lee

Michelle K. Lee
*Director of the United States Patent and Trademark Office*